US009073346B1

(12) United States Patent
Horiuchi et al.

(10) Patent No.: US 9,073,346 B1
(45) Date of Patent: Jul. 7, 2015

(54) METHOD FOR THERMAL HEAD ENERGIZING TIME CONTROL AT ASTABLE VOLTAGE

(71) Applicant: Brother Kogyo Kabushiki Kaisha, Nagoya-shi, Aichi-ken (JP)

(72) Inventors: Takashi Horiuchi, Kariya (JP); Mariko Niizeki, Ichinomiya (JP); Mohd Khairul Fatasha, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/501,114

(22) Filed: Sep. 30, 2014

(30) Foreign Application Priority Data

Dec. 27, 2013 (JP) ..... 2013-270880

(51) Int. Cl.
*B41J 2/25* (2006.01)
*B41J 2/355* (2006.01)

(52) U.S. Cl.
CPC ..... *B41J 2/355* (2013.01)

(58) Field of Classification Search
USPC ..... 347/16, 171, 211, 213–215, 217–219
See application file for complete search history.

(56) References Cited

U.S. PATENT DOCUMENTS 4,675,695 A * 6/1987 Samuel ..... 347/211
5,625,399 A * 4/1997 Wiklof et al. ..... 347/211
6,325,481 B1 * 12/2001 Pietz et al. ..... 347/16

FOREIGN PATENT DOCUMENTS

JP H08-300713 A 11/1996

* cited by examiner

*Primary Examiner* — Kristal Feggins
(74) *Attorney, Agent, or Firm* — Banner & Witcoff, Ltd.

(57) ABSTRACT

First fixed value is set as decreasing variable number C and second fixed value corresponding to measured resistance value of a thermal head is determined as constant K(R). Energization of the thermal head is started immediately after start of printing period and the energization is kept until lapse of pulse application time calculated based on chopping duty ratio determined based on thermal head voltage and the constant K(R). Engergization of the thermal head is stopped at lapse of the pulse application time and withheld until lapse of unit time. Calculation value (C(V)×K(TH)) calculated based on temperature and voltage of the thermal head is decremented from the current decreasing variable number C to obtain renewed decreasing variable number C. When the renewed decreasing variable number C is larger than 0, serial processes of calculating pulse application time, keeping and withholding energization of the thermal head are repeated.

8 Claims, 11 Drawing Sheets

| | TAPE A | TAPE B | TAPE C |
|---|---|---|---|
| BASIC CONSTANT Cmain | 55440 | 60440 | 52440 |

| RANK | CENTER OF RESISTANCE VALUE | K(R) |
|---|---|---|
| A | TRUE VALUE×90% | 0.9 |
| B | TRUE VALUE×100% | 1.0 |
| C | TRUE VALUE×110% | 1.1 |

FIG. 9

FOR RANK A

| Voltage | C(V) | duty | Power |
|---|---|---|---|
| 7.2 | 3708 | 82% | 598 |
| 7.3 | 3857 | 82% | 600 |
| 7.4 | 4009 | 82% | 596 |
| 7.5 | 4164 | 82% | 608 |
| 7.6 | 4322 | 82% | 595 |
| 7.7 | 4483 | 82% | 603 |
| 7.8 | 4564 | 78% | 600 |
| 7.9 | 4564 | 75% | 600 |
| 8.0 | 4564 | 73% | 600 |
| 8.1 | 4564 | 70% | 600 |
| 8.2 | 4564 | 68% | 600 |
| 8.3 | 4564 | 65% | 600 |
| 8.4 | 4564 | 64% | 600 |
| 8.5 | 4564 | 61% | 600 |
| 8.6 | 4564 | 60% | 600 |
| 8.7 | 4564 | 58% | 600 |
| 8.8 | 4564 | 56% | 600 |
| 8.9 | 4564 | 54% | 600 |
| 9.0 | 4564 | 53% | 600 |
| 9.1 | 4564 | 52% | 600 |
| 9.2 | 4564 | 50% | 600 |

FIG. 10

FOR RANK B

| Voltage | C(V) | duty | Power |
|---|---|---|---|
| 7.2 | 3708 | 91% | 598 |
| 7.3 | 3857 | 91% | 600 |
| 7.4 | 4009 | 91% | 596 |
| 7.5 | 4164 | 91% | 608 |
| 7.6 | 4322 | 91% | 595 |
| 7.7 | 4483 | 91% | 603 |
| 7.8 | 4564 | 86% | 600 |
| 7.9 | 4564 | 84% | 600 |
| 8.0 | 4564 | 81% | 600 |
| 8.1 | 4564 | 78% | 600 |
| 8.2 | 4564 | 75% | 600 |
| 8.3 | 4564 | 73% | 600 |
| 8.4 | 4564 | 71% | 600 |
| 8.5 | 4564 | 68% | 600 |
| 8.6 | 4564 | 66% | 600 |
| 8.7 | 4564 | 65% | 600 |
| 8.8 | 4564 | 62% | 600 |
| 8.9 | 4564 | 60% | 600 |
| 9.0 | 4564 | 59% | 600 |
| 9.1 | 4564 | 57% | 600 |
| 9.2 | 4564 | 55% | 600 |

FIG. 11

FOR RANK C

| Voltage | C(V) | duty | Power |
|---|---|---|---|
| 7.2 | 3708 | 100% | 598 |
| 7.3 | 3857 | 100% | 600 |
| 7.4 | 4009 | 100% | 596 |
| 7.5 | 4164 | 100% | 608 |
| 7.6 | 4322 | 100% | 595 |
| 7.7 | 4483 | 100% | 603 |
| 7.8 | 4564 | 95% | 600 |
| 7.9 | 4564 | 92% | 600 |
| 8.0 | 4564 | 89% | 600 |
| 8.1 | 4564 | 86% | 600 |
| 8.2 | 4564 | 83% | 600 |
| 8.3 | 4564 | 80% | 600 |
| 8.4 | 4564 | 78% | 600 |
| 8.5 | 4564 | 75% | 600 |
| 8.6 | 4564 | 73% | 600 |
| 8.7 | 4564 | 71% | 600 |
| 8.8 | 4564 | 68% | 600 |
| 8.9 | 4564 | 66% | 600 |
| 9.0 | 4564 | 65% | 600 |
| 9.1 | 4564 | 63% | 600 |
| 9.2 | 4564 | 61% | 600 |

FIG. 12

| TEMPERATURE | CORRECTIVE COEEFICIENT |
|---|---|
| 10 | 0.74 |
| 11 | 0.75 |
| 12 | 0.77 |
| 13 | 0.78 |
| 14 | 0.80 |
| 15 | 0.81 |
| 16 | 0.83 |
| 17 | 0.85 |
| 18 | 0.87 |
| 19 | 0.88 |
| 20 | 0.90 |
| 21 | 0.92 |
| 22 | 0.94 |
| 23 | 0.96 |
| 24 | 0.98 |
| 25 | 1.00 |
| 26 | 1.02 |
| 27 | 1.04 |
| 28 | 1.06 |
| 29 | 1.09 |
| 30 | 1.11 |
| 31 | 1.14 |
| 32 | 1.16 |
| 33 | 1.18 |
| 34 | 1.21 |
| 35 | 1.24 |
| 36 | 1.26 |
| 37 | 1.29 |
| 38 | 1.32 |
| 39 | 1.34 |
| 40 | 1.37 |

METHOD FOR THERMAL HEAD ENERGIZING TIME CONTROL AT ASTABLE VOLTAGE

CROSS REFERENCE TO RELATED APPLICATIONS

The present application claims priority from Japanese Patent Application No. 2013-270880 filed on Dec. 27, 2013, the disclosure of which is incorporated herein by reference in its entirety.

TECHNICAL FIELD

The disclosure relates to a method for thermal head energizing time control at astable voltage.

BACKGROUND

There has conventionally been proposed a method for thermal head energizing time control at astable voltage. For instance, there is a related method. Specifically, the conventional method is configured to control intermittent time of chopping pulse to be applied to a heat element so as to enable a thermal head to constantly secure stable heat even though power supply voltage varies due to load, etc. Thereby, print quality is constantly secured.

The conventional method has intended to set temperature rise of a heat element in the thermal head at a constant rate whereas an error of resistance value and ambient temperature of the thermal head have not been reflected for the control manner of intermittent time of chopping pulse.

SUMMARY

The disclosure has been made in view of the above-described problems and has an object to provide a method for thermal head energizing time control at astable voltage in such a manner that an error of resistance value and ambient temperature of a thermal head is reflected for the control.

To achieve the purpose of the disclosure, there is provided a method for thermal head energizing time control at astable voltage, wherein every printing period, the method carries out the steps of: (1) setting a first fixed value as initial value of a decreasing variable number and a second fixed value, the first fixed value corresponding to a type of printing medium subjected to print by the thermal head and the second fixed value corresponding to a measured resistance value of the thermal head; (2) starting energization of the thermal head immediately after a start of a printing period in simultaneous with detecting temperature and voltage of the thermal head; (3) determining a chopping duty ratio based on the voltage of the thermal head detected at the step (2) and the second fixed value set at the step (1); (4) starting energization of the thermal head and keeping the energization until lapse of a pulse application time which is calculated based on the chopping duty ratio determined at the step (3); (5) stopping the energization of the thermal head at the lapse of the pulse application time calculated based on the chopping duty ratio determined at the step (3) and withholding the energization until lapse of a unit time; (6) decrementing a calculation value from the decreasing variable so as to obtain a renewed decreasing variable number, the calculation value being calculated by using the temperature and the voltage of the thermal head detected at the step (2); and (7) repeating series of the steps (2) through (6) in a case where the renewed decreasing variable number is larger than a predetermined value whereas withholding the energization of the thermal head until the lapse of the printing period in a case where the renewed decreasing variable number is equal to or smaller than the predetermined value.

There is further provided a method for thermal head energizing time control at astable voltage, wherein every printing period, the method carries out the steps of: (1) setting a first fixed value as initial value of a decreasing variable number and a second fixed value, the first fixed value corresponding to a type of printing medium subjected to print by the thermal head and the second fixed value corresponding to a measured resistance value of the thermal head; (2) starting energization of the thermal head immediately after a start of a printing period in simultaneous with detecting temperature and voltage of the thermal head; (3) determining a chopping duty ratio based on the voltage of the thermal head detected at the step (2) and the second fixed value set at the step (1); (4) starting energization of the thermal head and keeping the energization until lapse of a pulse application time which is calculated based on the chopping duty ratio determined at the step (3); (5) stopping the energization of the thermal head at the lapse of the pulse application time calculated based on the chopping duty ratio determined at the step (3) and withholding the energization until lapse of a unit time; (6) decrementing a calculation value from the decreasing variable number so as to obtain a renewed decreasing variable number, the calculation value being calculated by using the temperature and the voltage of the thermal head detected at the step (2); and (7) repeating series of the steps (2) through (6) in a case where the renewed decreasing variable number is larger than a predetermined value whereas withholding the energization of the thermal head until the lapse of the printing period in a case where the renewed decreasing variable number is equal to or smaller than the predetermined value, wherein, in a case where the voltage detected at the step (2) is equal to or lower than a threshold, a value of the chopping duty ratio is set to "1" at the step (3).

BRIEF DESCRIPTION OF THE DRAWINGS

FIG. 9 shows a data table used for the "astable energization control method";

FIG. 10 shows a data table used for the "astable energization control method";

FIG. 11 shows a data table used for the "astable energization control method";

FIG. 12 shows a data table used for the "astable energization control method";

DETAILED DESCRIPTION

There will be given a detailed description of an exemplary embodiment of a method for thermal head energizing time control at astable voltage, embodying the disclosure, by referring to the accompanying drawings.

1. External Configuration of Tape Printing Apparatus

There will be described details about schematic configuration of a tape printing apparatus 1 that carries out the "astable conduction control method" directed to the disclosure by referring to FIG. 1 and FIG. 3.

Figure 1:
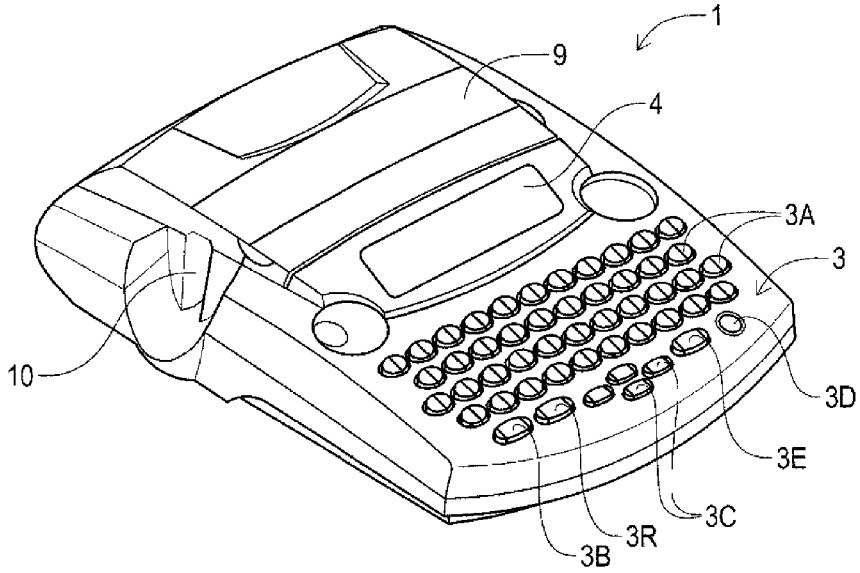
FIG. 1 is a perspective view of a tape printing apparatus that carries out the method for thermal head energizing time control at astable voltage (termed as "astable energization control method" hereinafter) directed to an embodiment of the disclosure.

As shown in FIG. 1, the tape printing apparatus 1 is a printer for carrying out printing on a tape fed from a tape cassette 5 (refer to FIG. 3) housed inside a cabinet of the tape printing apparatus 1. The tape printing apparatus 1 includes a keyboard 3 and a liquid crystal display 4 on the top of the cabinet. Further, there is arranged a cassette holding portion 8 (refer to FIG. 3) for holding the tape cassette 5. The cassette holding portion 8 is a rectangular shape when seen from top, placed inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wire line connection or wireless connection. Accordingly, the tape printing apparatus 1 is capable of printing out printing data transmitted from an external apparatus.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power supply from a battery cell 81 (refer to FIG. 4 to be described later). The setting key 3E is operated for setting various conditions. The return key 3R is operated for executing a line feeding instruction or various processing and for determining a choice from candidates.

The liquid crystal display 4 is a display device for indicating characters such as letters, etc. in plural lines, i.e., displaying printing data created by the keyboard 3.

Figure 3:
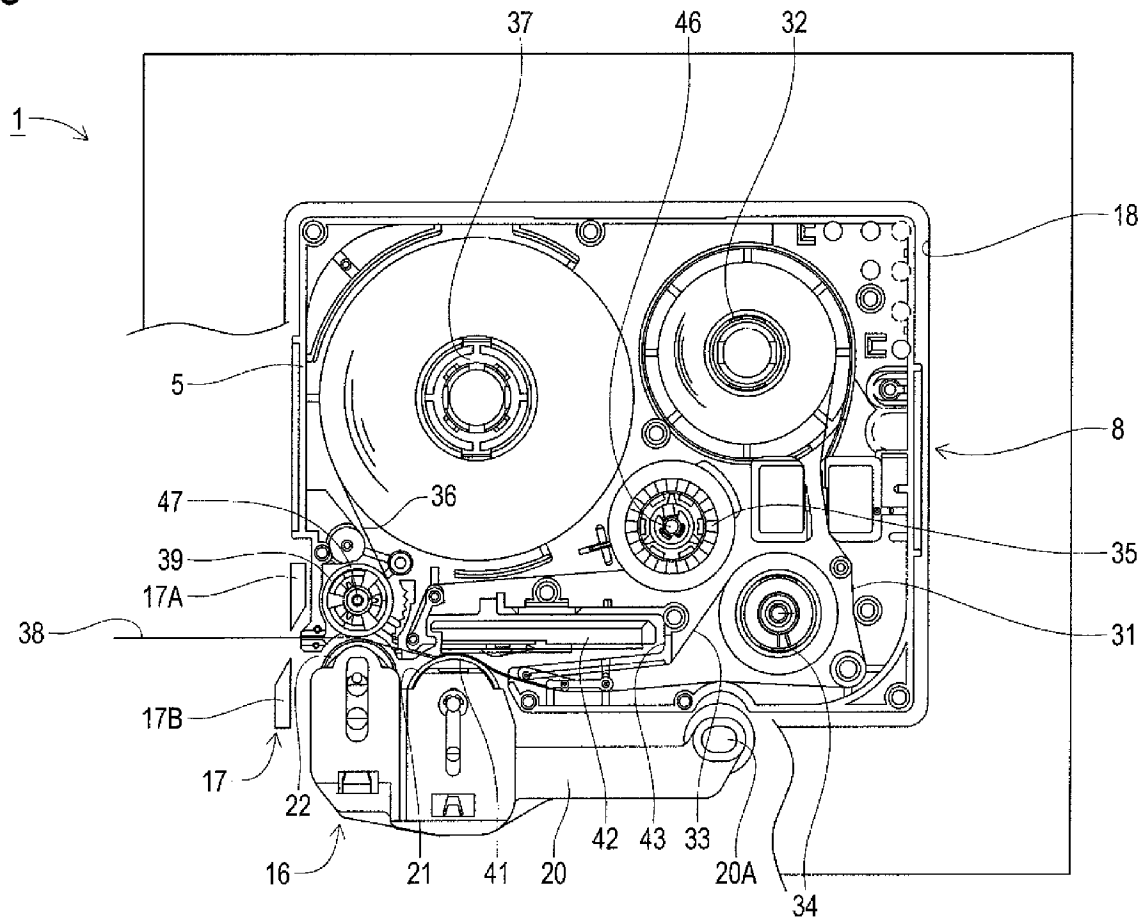
FIG. 3 is a top plan view showing a vicinity of a cassette holding portion of the tape printing apparatus.

As shown in FIG. 3, the tape printing apparatus 1 is configured such that the tape cassette 5 can be replaceably placed in the cassette holding portion 8 arranged inside thereof. Further, inside the tape printing apparatus 1, there are arranged a tape driving and printing mechanism 16 and tape cutting mechanism including a cutter 17. The tape printing apparatus 1 is capable of carrying out printing onto a tape fed from the tape cassette 5 by the tape driving and printing mechanism 16 in accordance with desired printing data. Further, the tape printing apparatus 1 is capable of cutting off a printed tape with the cutter 17 constituting the tape cutting mechanism. The printed tape thus cut off is ejected from the tape ejecting portion 10 formed on the left side of the tape printing apparatus 1.

Inside the tape printing apparatus 1, a cassette holding frame 18 is arranged. As shown in FIG. 3, the tape cassette 5 is replaceably placed into the cassette holding frame 18.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 is wound around the tape spool 32. The surface tape 31 is made of a transparent tape such as PET (polyethylene terephthalate) film or the like. An ink ribbon 33 is wound around the ribbon feeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is put outside. The bonding roller 39 is used for bonding the double tape 36 and the surface tape 31 together.

As shown in FIG. 3, in the cassette holding frame 18, an arm 20 is arranged around a shaft 20A in a pivotal manner. A platen roller 21 and a conveying roller 22 are rotatably supported at the front edge of the arm 20. Both the platen roller 21 and the conveying roller 22 employ a flexible member made of rubber or the like for their surfaces.

When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

Figure 2:
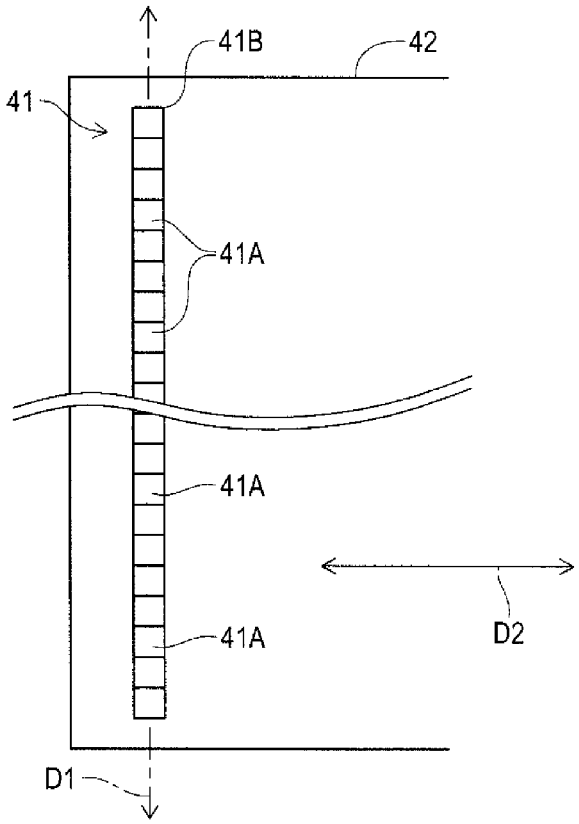
FIG. 2 is an enlarged view of the thermal head of the tape printing apparatus.

A plate 42 is arranged upright inside the cassette holding frame 18. The plate 42 includes a thermal head 41 at its side surface facing the platen roller 21. As shown in FIG. 2, the thermal head 41 consists of a line head 41B or the like made up of a plurality (e.g., 1024 pieces or 2048 pieces) of heat elements 41A aligned in the width direction of the surface tape 31 and the double tape 36.

In this connection, the direction that the heat elements 41A are aligned is the "main scanning direction D1 for the thermal head 41". Further, a direction that the surface tape 31 and the ink ribbon 33 moves passing the thermal head 41 is the "sub scanning direction D2 for the thermal head 41".

Reverting to FIG. 3, when the tape cassette 5 is placed in a predetermined position, the plate 42 is fitted in a concave portion 43 of the tape cassette 5.

Further, as shown in FIG. 3, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

Figure 4:
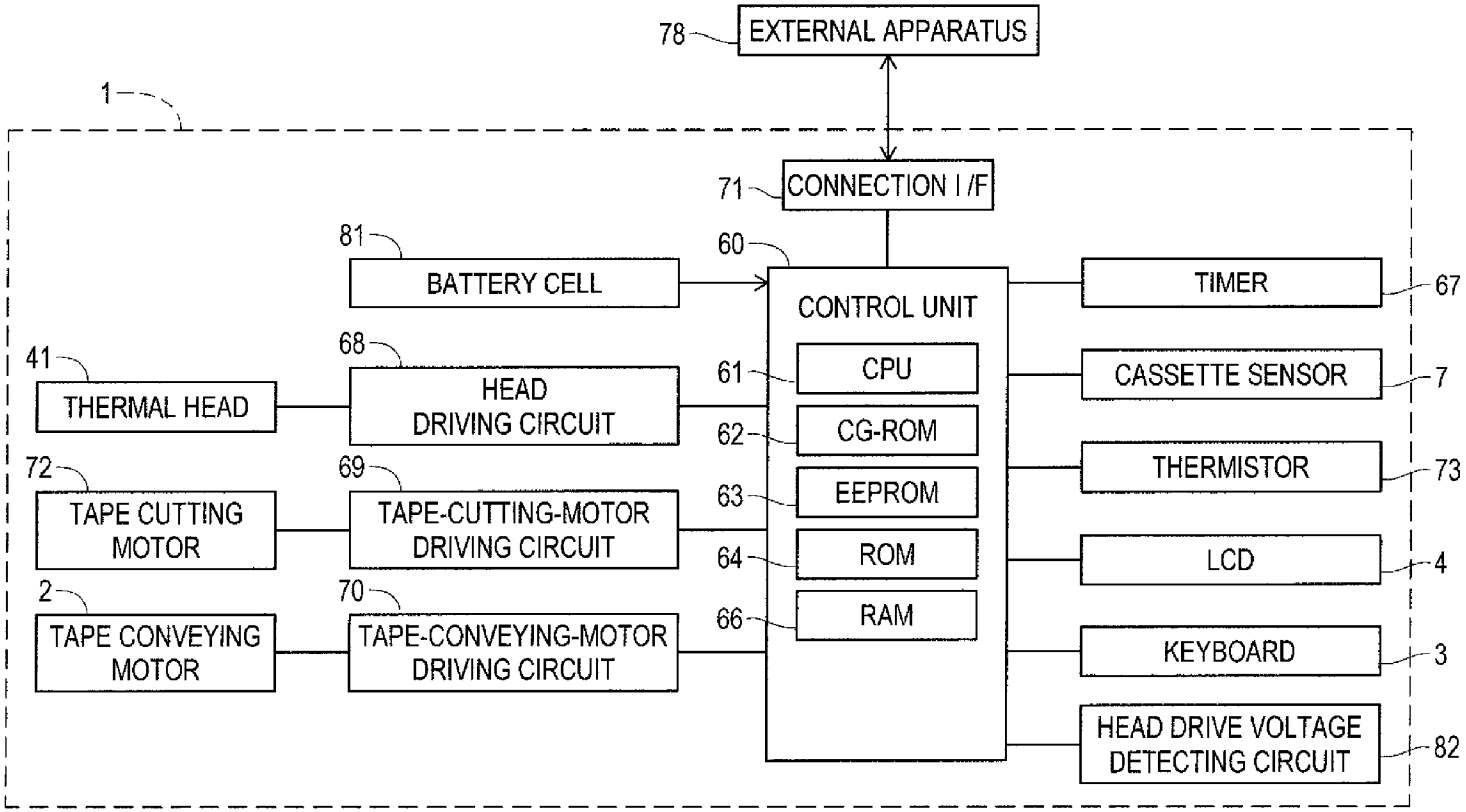
FIG. 4 is a block diagram illustrating a control system of the tape printing apparatus.

In the cassette holding frame 18, there is arranged a tape conveying motor 2 (refer to FIG. 4 to be described later). Driving force of the tape conveying motor 2 is transmitted to the platen roller 21, the conveying roller 22, the ribbon-take-up roller 46 and the bonding-roller driving roller 47, etc. via series of gears arranged along the cassette holding frame 18.

Accordingly, when rotation of an output shaft of the tape conveying motor 2 is started with supply of power to the tape conveying motor 2, rotation of the used-ribbon-take-up spool 35, the bonding roller 39, the platen roller 21 and the conveying roller 22 is started in conjunction with the operation of the tape conveying motor 2. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, in the tape printing apparatus 1 of the embodiment, the surface tape 31 and the ink ribbon 33 are conveyed with being pressed by the platen roller 21 and the thermal head 41. At this moment, considerable number of the heat elements 41A aligned on the thermal head 41 are selectively and intermittently energized (in a manner of pulse application) by a control unit 60 (refer to FIG. 4) in accordance with printing data and a program of "astable energization control method" to be described later.

Each heat element 41A gets heated by power supply and melts or sublimes ink applied on the ink ribbon 33. Therefore, ink in the ink layer on the ink ribbon 33 is transferred onto the surface tape 31 in a unit of dots. Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the boding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism consists of the cutter 17 and the tape cutting motor 72 (refer to FIG. 4). The cutter 17 includes a fixed blade 17A and a rotary blade 17B. More specifically, the cutter 17 is a scissors-like cutter that cuts off an object to be cut off by rotating the rotary blade 17B against the fixed blade 17A. The rotary blade 17B is arranged so as to be able to rotate back and forth with reference to a shaft thereof with the aid of the tape cutting motor 72. Accordingly, the laminated tape 38 is cut off with the fixed blade 17*a* and the rotary blade 17B along operation of the tape cutting motor 72.

The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as adhesive label that can be adhered to an arbitrary place.

2. Internal Configuration of the Tape Printing Apparatus

Next, the control configuration of the tape printing apparatus 1 will be described referring to drawings. As shown in FIG. 4, inside the tape printing apparatus 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69, the tape-conveying-motor driving circuit 70, the battery cell 81 and a head drive voltage detecting circuit 82. The control unit 60 is also connected to the liquid crystal display 4, a cassette sensor 7, a thermistor 73, the keyboard 3 and a connection interface 71.

The CPU 61 is a central processing unit that plays a primary role for various system controls of the tape printing apparatus 1. Accordingly, the CPU 61 controls various peripheral devices such as the liquid crystal display 4 etc. in accordance with input signals from the keyboard 3 as well as various control programs.

The CG-ROM 62 is a character generator memory wherein image data of to-be-printed letters and signs are associated with code data and stored in dot patterns. The EEPROM 63 is a non-volatile memory that allows data write for storing therein and deletion of stored data therefrom. The EEPROM 63 stores data that indicates user setting etc. of the tape printing apparatus 1.

The ROM 64 stores various control programs and various data for the tape printing apparatus 1. Accordingly, programs and data tables for "astable energization control method" to be described later are stored in the ROM 64.

The RAM 66 is a storing device for temporarily storing a processing result of the CPU 61 etc. The RAM 66 also stores printing data created with inputs by means of the keyboard 3, printing data taken therein from external apparatus 78 via the connection interface 71.

The timer 67 is a time-measuring device that measures passage of predetermined length of time for executing control of the tape printing apparatus 1. More specifically, the timer 67 is referred in programs for the "astable energization control method" to be describer later so as to detect a printing cycle, a unit time (250 μm sec.), start and termination of an energization (pulse application) period for a heat element 41A of the thermal head 41, etc. Further, the thermistor 73 is a sensor that detects temperature in vicinity of the thermal head 41 and attached on the thermal head 41. Further, the head drive voltage detecting circuit 82 is a circuit that serves to detect voltage of the thermal head as head drive detection voltage.

The head driving circuit 68 is a circuit that serves to supply a driving signal to the thermal head 41 for controlling drive state of the thermal head 41 in response to a control signal from the CPU 61 along with control programs for "astable energization control method" to be described later. In this connection, the head driving circuit 68 controls to energize and de-energize each of the heat elements 41A based on a signal (strobe (STB) signal) associated with a strobe number assigned to each heat element 41A for comprehensively controlling heating manner of the thermal head 41. The tape-cutting-motor driving circuit 69 is a circuit that serves to supply a driving signal to the tape cutting motor 72 based on the control signal from the CPU 61 for controlling operation of the tape cutting motor 72. Further, the tape-conveying motor driving circuit 70 is a control circuit that serves to supply a driving signal to a tape conveying motor 2 based on the control signal from the CPU 61 for controlling operation of the tape conveying motor 2.

Outline of "Astable Energization Control Method"

Next, there will be described on the "astable energization control method" carried out by the above-described tape printing apparatus 1 directed to the present embodiment.

In the "astable energization control method", a determination to de-energize the thermal head 41 during a printing period is made within an astable energization control time which is significantly short while pulse application voltage of the thermal head 41 is monitored. Consequently, an energizing time of the thermal head 41 bears a proportionate relationship to a value of integral of application voltage of the thermal head 41.

Figure 13A:
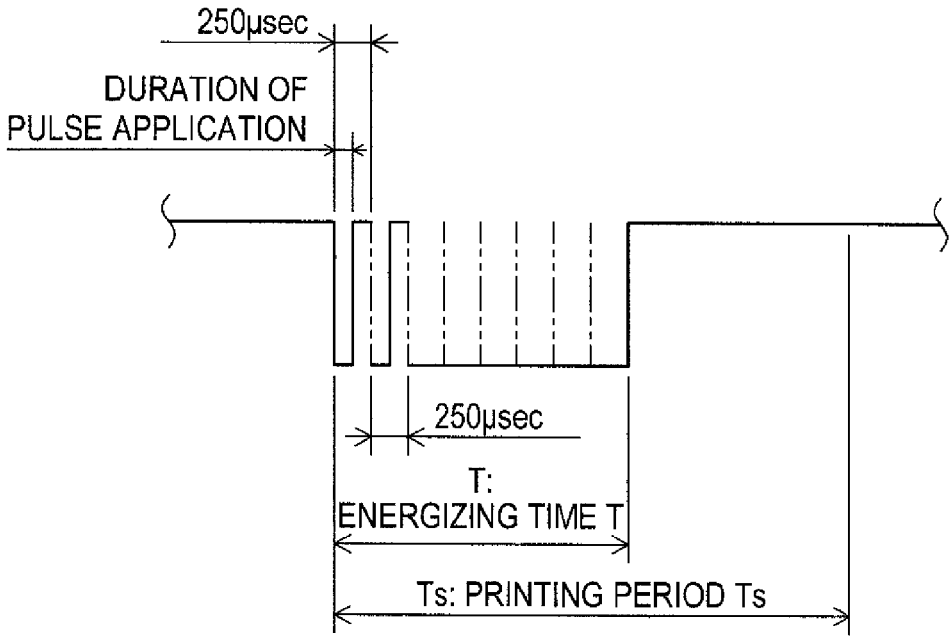
FIG. 13A is a pulse application diagram for schematically illustrating the "astable energization control method"
Figure 13B:
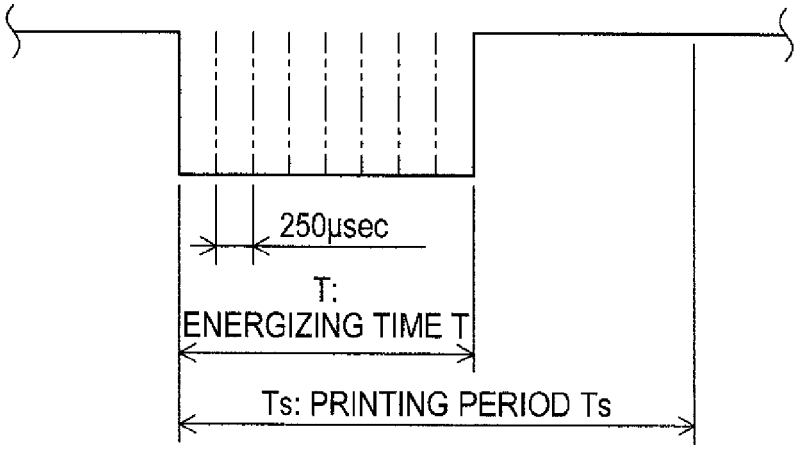
FIG. 13B is a pulse application diagram for schematically illustrating the "astable energization control method".

Especially, in the "astable energization control method" directed to the present embodiment, a determination to de-energize the thermal head 41 during a printing period is made within 250 μm sec. set as a unit time while application voltage of the thermal head 41 is monitored. As shown in FIG. 13A and FIG. 13B, a printing period Ts is divided by a unit time (250 μm sec) so that energization (pulse application) of the thermal head 41 is controlled every unit time (250 μm sec) in a form of a chopping duty ratio.

Figures 7, 8A, 8B:
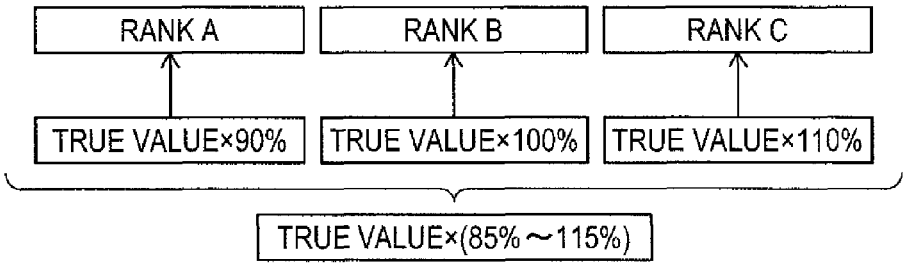
FIG. 7 shows a data table used for the "astable energization control method"
FIG. 8A shows ranks classified by error level of a resistance value of the thermal head.
FIG. 8B shows a data table used for the "astable energization control method"

A chopping duty ratio is determined based on voltage of the thermal head 41 and a second fixed value which is determined according to a measured resistance value of the thermal head 41. As shown in FIG. 8A, ranks A, B and C are prepared to classify a second fixed value which is determined according to a measured resistance value of the thermal head 41. As shown in FIG. 8B, a constant K(R) is set for each rank, namely, a constant K(R) of 0.9 for rank A, 1.0 for rank B and 1.1 for rank C.

As shown in FIG. 8A, a measured value falling within a range from more than 85% to less than 95% of a true value of resistance value of the thermal head 41 is classified as rank A, a measured value falling within a range from more than 95% to less than 105% of a true value of resistance value of the thermal head 41 is classified as rank B, and a measured value falling within a range from more than 105% to less than 115% of a true value of resistance value of the thermal head 41 is classified as rank C. Accordingly, a center of rank A is 90% of a true value of resistance value of the thermal head 41, a center of rank B is 100% of a true value of resistance value of the thermal head 41, and a center of rank C is 110% of a true value of resistance value of the thermal head 41.

Incidentally, a resistance value of a thermal head 41 is measured before the thermal head 41 is attached to the tape printing apparatus 1. A thermal head 41 of which a measured resistance value falls within any one of the ranks A, 13 and C is qualified for attachment to the tape printing apparatus 1. Accordingly, a measured resistance value of a thermal head 41 attached to the tape printing apparatus 1 falls within a range from more than 85% to less than 115% of a true value of the resistance value of the thermal head 41.

As shown in FIG. 8B, a constant K(R) as second fixed value is determined according to each rank. More specifically, in a case where a measured resistance value of a thermal head 41 falls within rank A, a second fixed value is determined to be a constant K(R) of "0.9". In a case where a measured resistance value of a thermal head 41 falls within rank B, a second fixed value is determined to be a constant K(R) of "1.0". In a case where a measured resistance value of a thermal head 41 falls within rank C, a second fixed value is determined to be a constant K(R) of "1.1". A second fixed value is thus determined depending on a measured resistance value of a thermal head 41.

In a case where a second fixed value is determined to be "1.0" based on a measured resistance value of a thermal head 41, namely, in a case where the measured resistance value thereof falls within rank B, a chopping duty ratio is set under 100% as indicated at a "duty" column in the data table of FIG. 10. In that case, energization (pulse application) of the thermal head 41 is started from a start of a unit time (250 μm sec.) and continued for a time of which duration is a product of the unit time (250 μm sec.) and a chopping duty ratio. After that, energization (pulse application) of the thermal head 41 is withheld until expiration of the unit time (250 μm sec.). That is, when voltage higher than 7.2 V is used, energization of the thermal head 41 is performed every unit time (250 μm sec.), wherein duration of energization within a unit time (250 μm sec.) is a product of the unit time (250 μm sec.) and a chopping duty ratio.

Further, in a case where a second fixed value is determined to be "0.9" based on a measured resistance value of a thermal head 41, namely, in a case where the measured resistance value thereof falls within rank A, a chopping duty ratio is set under 100% as indicated at a "duty" column in the data table of FIG. 9. In that case, energization (pulse application) of the thermal head 41 is started from a start of a unit time (250 μm sec.) and continued for a time of which duration is a product of the unit time (250 μm sec.) and a chopping duty ratio. After that, energization (pulse application) of the thermal head 41 is withheld until expiration of the unit time (250 μm sec.). That is, when voltage higher than 7.2 V is used, energization of the thermal head 41 is performed every unit time (250 μm sec.), wherein duration of energization within a unit time (250 μm sec.) is a product of the unit time (250 μm sec.) and a chopping duty ratio.

In this connection, each value at the "duty" column in the data table of FIG. 9 (i.e., in a case where a measured resistance value of a thermal head 41 falls within rank A) can be obtained by multiplying each value at the "duty" column with the same voltage level in the data table of FIG. 10 (i.e., in a case where a measured resistance value of a thermal head 41 falls within rank B) by "0.9" which is the second fixed value set thereto when a measured resistance value of a thermal head 41 falls within rank A.

Further, in a case where a second fixed value is determined to be "1.1" based on a measured resistance value of a thermal head 41, namely, in a case where the measured value thereof falls within rank C, a chopping duty ratio is set to 100% when voltage at the thermal head 41 falls within a range from 7.2 V to 7.7 V so that energization (pulse application) of the thermal head 41 is fully continued during the unit time (250 μm sec.). That is, energization of the thermal head 41 is performed full time during a unit time when low voltage is used for rank C.

Meanwhile, when voltage at the thermal head 41 is higher than 7.7 V, a chopping duty ratio is set under 100% for rank C. In that case, energization (pulse application) of the thermal head 41 is started from a start of a unit time (250 μm sec.) and continued for a time of which duration is a product of the unit time (250 μm sec.) and a chopping duty ratio. After that, energization (pulse application) of the thermal head 41 is withheld until expiration of the unit time (250 μm sec.). That is, when voltage higher than 7.7 V is used, energization of the thermal head 41 is performed every unit time (250 μm sec.), wherein duration of energization within a unit time (250 μm sec.) is a product of the unit time (250 μm sec.) and a chopping duty ratio.

In this connection, each value at the "duty" column in the data table of FIG. 11 (i.e., in a case where a measured resistance value of a thermal head 41 falls within rank C) can be obtained by multiplying each value at the "duty" column with the same voltage level in the data table of FIG. 10 (i.e., in a case where a measured resistance value of a thermal head 41 falls within rank B) by "1.1" which is the second fixed value set thereto when a measured resistance value of a thermal head 41 falls within rank C.

Incidentally, each chopping duty ratio at voltage higher than 7.7 V is calculated based on average amount of energy given to a thermal head 41 during a unit time (250 μm sec.) when voltage of the thermal head 41 falls within a range from 7.2 V to 7.7V, i.e., when a chopping duty ratio is set to 100%. That is, a chopping duty ratio set at the time of high voltage is calculated based average amount of pulse-application energy given to a thermal head 41 with a chopping duty ratio of 100% set at the time of low voltage. Average amount of pulse-application energy given to a thermal head 41 at the time of low voltage can be thus used for setting a chopping duty ratio at the time of high voltage per significantly short time such as unit time (250 μm sec.). Thereby, there can be precisely set pulse-application energy required at each high voltage level.

More specifically, according to the data table of FIG. 11 (i.e., in a case where a measured resistance value of a thermal head 41 falls within rank C), the value "598" indicated at the "power" column with voltage level of 7.2 V at the thermal head 41 means amount of energy given to the thermal head 41 during a unit time (250 μm sec.) on that condition. Further, "600" is amount of energy given to the thermal head 41 during a unit time (250 μm sec.) with voltage level of 7.3 V at the thermal head 41. Further, "596" is amount of energy given to the thermal head 41 during a unit time (250 μm sec.) with voltage level of 7.4 V at the thermal head 41. Further, "608" is amount of energy given to the thermal head 41 during a unit time (250 μm sec.) with voltage level of 7.5 V at the thermal head 41. Further, "595" is amount of energy given to the thermal head 41 during a unit time (250 μm sec.) with voltage level of 7.6 V at the thermal head 41. Further, "603" is amount of energy given to the thermal head 41 during a unit time (250 μm sec.) with voltage level of 7.7 V at the thermal head 41.

Accordingly, "600" is obtained as average amount of pulse-application energy given to a thermal head 41 at the time of low voltage within the range from 7.2 V to 7.7 V. Therefore, each chopping duty ratio at the time of voltage higher than 7.7 V is set to a value which makes amount of energy given to a thermal head 41 during a unit time (250 μm sec.) "600".

Thus, based on a data table of proper rank determined according to a measured resistance value of a thermal head 41, energization (pulse application) of the thermal head 41 is controlled every unit time (250 μm sec.) by properly setting a chopping duty ratio. Energy control based on a chopping duty ratio setting is repeatedly at next unit time (250 μm sec.) on condition that a decreasing variable number C calculated at expiration of each unit time (250 μm sec.) is larger than "0" as long as the current printing period Ts does not reach the end. In a case where a decreasing variable number C calculated at expiration of each unit time (250 μm sec.) is under "0" at the current unit time (250 μm sec.), energy control based on a chopping duty ratio setting is terminated at the end of the current unit time and energization (pulse application) of the thermal head 41 is withheld thereafter until start of a next printing period Ts.

In this connection, a fixed number previously determined according to a type of a tape cassette 5 housed in the cassette holding portion 8 is assigned to the decreasing variable number C as its initial value. More specifically, as shown in the data table of FIG. 7, in a case where a type of a tape cassette 5 housed in the cassette holding portion 8 is tape A, the fixed number "55440" is assigned to the decreasing variable number C as its initial value. After that, a value determined based on voltage and ambient temperature of the thermal head 41 is decremented from the decreasing variable number C every unit time (250 μm sec.).

Incidentally, a value to be determined based on voltage and ambient temperature of the thermal head 41 is calculated by taking the following steps. Firstly, there is referred to one of values at "C(V)" column associated with respective voltage level of the thermal head 41 in any one of the data tables of FIG. 9 through FIG. 11 classified into three ranks determined according to a measured of resistance value of the thermal head 41. Next, from among values at the "corrective coefficient" column in the data table of FIG. 12, there is referred to a corrective coefficient associated with ambient temperature of the thermal head 41. By multiplying the value referred to at the "C(V)" column and the corrective coefficient referred to at the "corrective coefficient" column, a value to be determined based on voltage and ambient temperature of the thermal head 41 is obtained.

In "astable energization control method", in a case of either rank A or rank B determined to be so according to a measured resistance value of the thermal head 41 on condition that voltage of the thermal head 41 during a single printing period Ts falls within a range from 7.2 V to 9.2 V, energization (pulse application) of the thermal head 41, of which chopping duty ratio lowers 100%, is continuously repeated every unit time (250 μm sec.) from the start of the printing period Ts. Thereby, temperature rise of the thermal head 41 can be suppressed even at high voltage level, which can possibly prevent unintended cut-off of the ink ribbon 33 due to high-heat melting and reduce frequency of fusion at a part of a surface tape 31 onto which heat elements 41 get contact (so-called sticking). As to the case of FIG. 13A, an energizing time T corresponds to time that begins when the printing period Ts gets started and terminates when the decreasing variable number C turns to "0".

Meanwhile, in a case of rank C determined to be so according to a measured resistance value of the thermal head 41 on condition that voltage of the thermal head 41 during a single printing period Ts falls within a range from 7.2 V to 7.7 V, energization (pulse application) of the thermal head 41, of which chopping duty ratio is 100%, is continuously repeated every unit time (250 μm sec.) from the start of the printing period Ts until point of time at which the decreasing variable number C turns to "0" during the printing period Ts. As to the case of FIG. 13B, an energizing time T corresponds to time that begins when the printing period Ts gets started and terminates when the decreasing variable number C turns to "0".

Meanwhile, in a case where voltage of the thermal head 41 during a single printing period is higher than 7.7 V, energization (pulse application) of the thermal head 41, of which chopping duty ratio lowers 100%, is continuously repeated every unit time (250 μm sec.) from the start of the printing period Ts, as shown in FIG. 13A, for instance. Thereby, temperature rise of the thermal head 41 can be suppressed even at high voltage level, which can possibly prevent unintended cut-off of the ink ribbon 33 due to high-heat melting and reduce frequency of fusion at a part of a surface tape 31 onto which heat elements 41 get contact (so-called sticking). As to the case of FIG. 13A, an energizing time T corresponds to time that begins when the printing period Ts get started and terminates when the decreasing variable number C turns to "0".

When voltage of the thermal head 41 during the single printing period Ts thereafter falls within a range from 7.2 V to 7.7 V, energization (pulse application) of the thermal head 41, of which chopping duty ratio is 100%, is continuously repeated every unit time (250 μm sec.) until point of time at which the decreasing variable number C turns to "0" during the printing period Ts.

Among the data table of FIG. 9 (in a case where a measured resistance value of a thermal head 41 falls within rank A), the data table of FIG. 10 (in a case where a measured resistance value of a thermal head 41 falls within rank B) and the data table of FIG. 11 (in a case where a measured resistance value of a thermal head 41 falls within rank C), all the values indicated in the "C(V)" column are completely the same value (coefficients) at respective associated voltage levels in each of the three data tables.

Also, among the data table of FIG. 9 (in a case where a measured resistance value of a thermal head 41 falls within rank A), the data table of FIG. 10 (in a case where a measured resistance value of a thermal head 41 falls within rank B) and the data table of FIG. 11 (in a case where a measured resistance value of a thermal head 41 falls within rank C), all the values indicated in the "power" column are completely the same value (amount of energy) at respective associated voltage levels in each of the three data tables. The reason of the same value (amount of energy) lies in that both the ratio of the second fixed value and each value in the "duty" column are made the same among rank A, rank B and rank C.

It is to be noted that the data tables of FIG. 9, FIG. 10 and FIG. 11 are stored in the ROM 64. The data table of FIG. 8B is also store in the ROM 64, and so is a measured resistance value of the thermal head 41.

4. Flow Chart of "Astable Energization Control Method"

Next, there will be described on the flow chart of the main program shown in FIG. 5. The main program shown in FIG. 5 is executed by the control unit 60.

Figure 5:
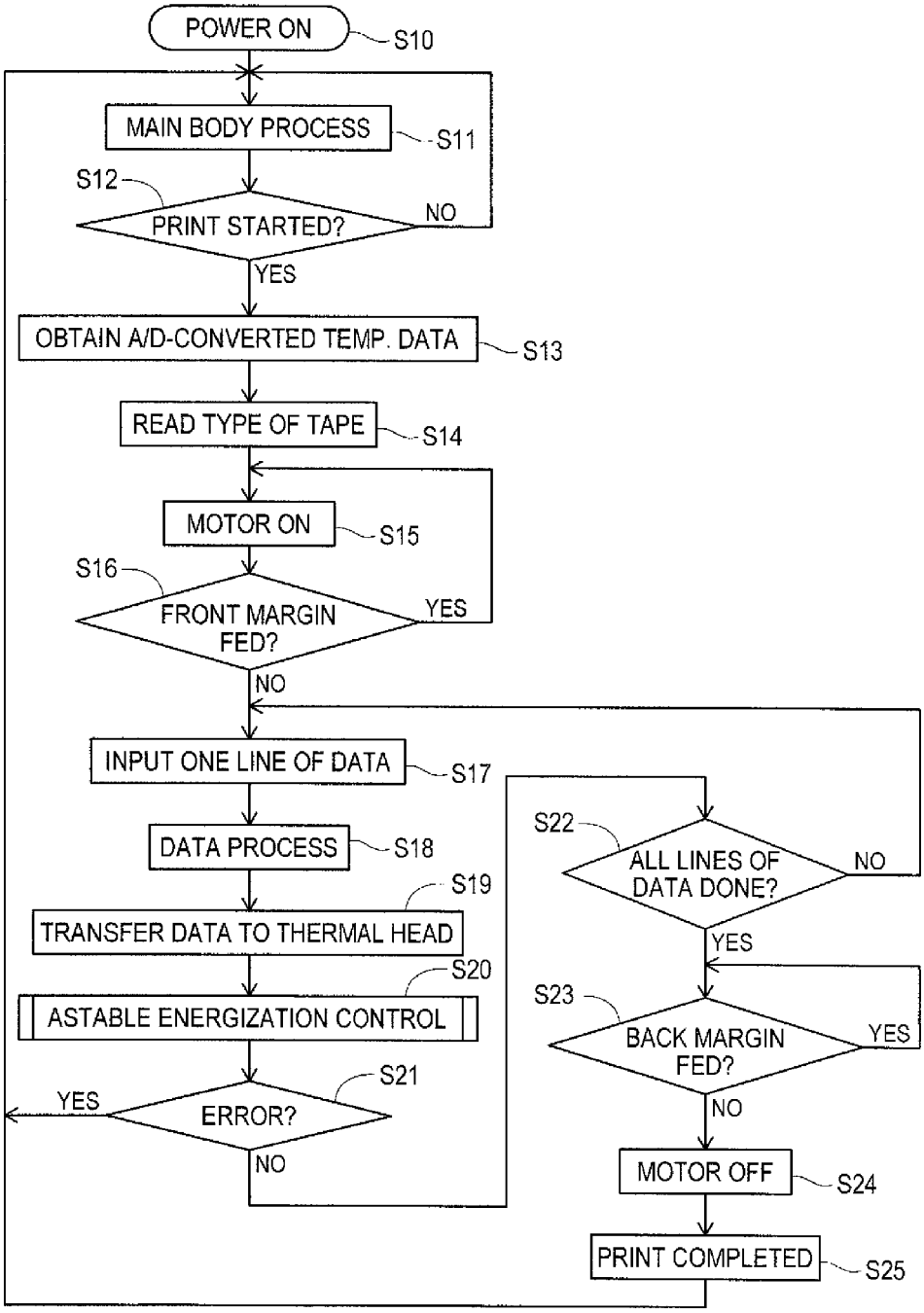
FIG. 5 is a flow chart of a main program executed for the tape printing apparatus.

In the main program shown in FIG. 5, when power is supplied to the battery cell 81 (S10), a main body process is firstly executed at S11. In the main body process, acceptance of a print command made by the print key 3B is mainly carried out while indication of print data, editing of print data, error recovery operation are also carried out by using the keyboard 3, the liquid crystal display 4, etc. After completion of the main body process, the process shifts to S12.

At S12, print-start or not is determined. A determination at S12 is made based on a print-command acceptance result at S11. In a case where print is not started (S12: NO), the process returns to S11 and the series of processes of S11 and S12 is repeated. In a case where print is started (S12: YES), the process shifts to S13.

At S13, ambient temperature of the thermal head 41 is detected by the thermistor 73 in a manner of analog to digital conversion. Temperature information is obtained at S13 for pulse application control according to environmental temperature. After that, the process shifts to S14.

At S14, the type of the tape cassette 5 housed in the cassette holding portion 8 is read by the cassette sensor 7. Cassette-type information is obtained at S14 for pulse application control according to type of the tape cassette 5. After that, the process shifts to S15.

At S15, the tape conveying motor 2 is turned on. After that, the process shifts to S16.

At S16, it is detected whether or not the surface tape 31 housed in the tape cassette 5 is fed by a length for a front margin. Thereby, a front margin is secured. In a case where the surface tape 31 housed in the tape cassette 5 is not fed by a length for a front margin (S16: NO), the process returns to S15 and the series of processes of S15 and S16 is repeated. In a case where the surface tape 31 housed in the tape cassette 5 is fed by a length for a front margin (S16: YES), the process shifts to S17.

At S17, data input is carried out with respect to one line of data corresponding to the line head 41B of the thermal head 41. That is, arrangement of bits for print image data is converted from the sub-scanning direction D2 to the main-scanning direction D1 of the thermal head 41, which is so-called longitudinal-lateral conversion. From the longitudinal-lateral converted print image data, there is taken out one line of data in the sub-scanning direction D2 of the thermal head 41. After that, the process shifts to S18.

At S18, a data process is carried out. Thereby, one line of data at S17 is converted to another-form data which enables energization control of the thermal head 41. After that, the process shifts to S19.

At S19, the data obtained at S18 is transferred to the thermal head 41 through the head driving circuit 68. At this stage, print data is transferred to a shift register of the thermal head 41 and data latch is completed. After that, the process shifts to S20.

At S20, astable energization control directed to the "astable energization control method" of the present embodiment is executed. The details of the astable energization control will be described later. After that, the process shifts to S21.

At S21, it is determined whether or not an error occurs. An error referred to here may be necessity of battery change, etc. In a case where an error occurs (S21: YES), current print is forcedly terminated and the process subsequently retunes S11 so that the series of processes of S11 through S21 is repeated. In a case of no error (S21: NO), the process shifts to S22.

At S22, it is detected whether or not the series of processes of S17 through S20 is done for all the lines of data in the sub-scanning direction D2 of the thermal head 41. In a case where the series of processes of S17 through S20 is not yet done for all the lines of data in the sub-scanning direction D2 of the thermal head 41 (S22: NO), the process returns to S17 and processes to follow S17 are repeated. Thereby, the series of processes is done through for the rest lines of data. In a case where the series of processes of S17 through S20 is done for all the lines of data in the sub-scanning direction D2 of the thermal head 41 (S22: YES), the process shifts to S23.

At S23, it is detected whether or not the surface tape 31 housed in the tape cassette 5 is fed by a length for a back margin. Thereby, a back margin is secured. In a case where the surface tape 31 housed in the tape cassette 5 is not fed by a length for a back margin (S23: NO), the process returns to S23 and the step of S23 is repeated. In a case where the surface tape 31 housed in the tape cassette 5 is fed by a length for a back margin (S23: YES), the process shifts to S24.

At S24, the tape conveying motor 2 is turned off. After that, the process shifts to S25.

At S25, control for print is completed. After that, the process returns to S11 and the series of processes to follow S11 are repeated.

Figure 6:
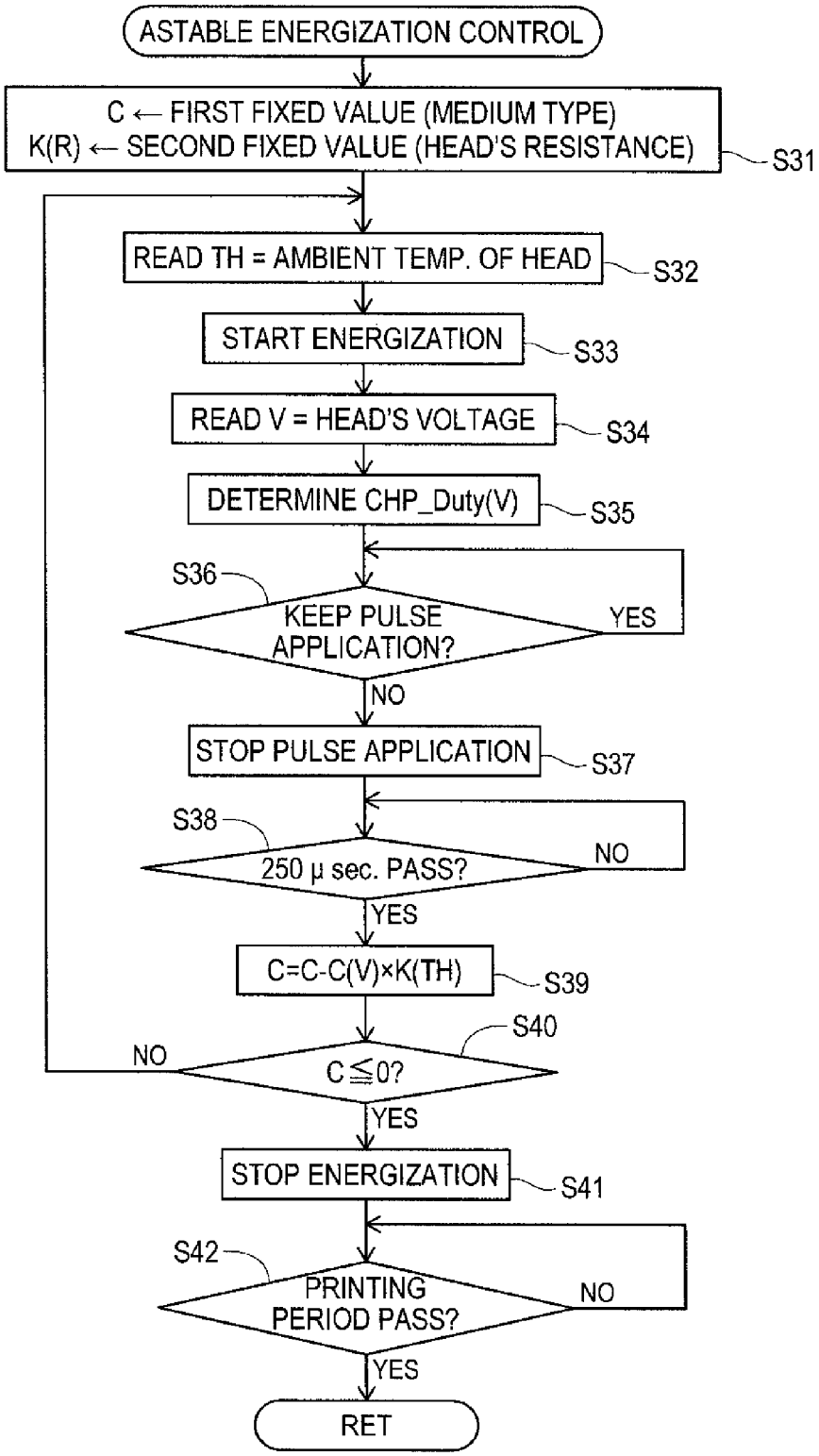
FIG. 6 is a flow chart of the "astable energization control method" for the tape printing apparatus.

Next, there will be described on the astable energization control at S20 in FIG. 5. In the astable energization control of S20 shown in FIG. 5, a first fixed value corresponding to a type of a tape cassette 5 is assigned to a decreasing variable number C as its initial value at S31 as shown in FIG. 6. The decreasing variable number C is stored in the RAM 66. In the RAM 66, there is further stored a constant K(R) as a second fixed value which is determined according to a measured resistance value of the thermal head 41. Having been explained already at [Outline of "Astable Energization Control Method"] in detail, the calculation to obtain a constant K(R) as a second fixed value which is determined according to a measured resistance value of the thermal head 41 will be omitted.

Here will be described on a constant corresponding to a type of a tape cassette 5. A constant corresponding to a type of a tape cassette 5 is a fixed value which is related to essential application energy and individually set for a type of a print medium. More specifically, according to the data table shown FIG. 7, a constant corresponding to a type A of a tape cassette 5 is "55440", a constant corresponding to a type B of a tape cassette 5 is "60440" and a constant corresponding to a type C of a tape cassette 5 is "52440". The data table shown in FIG. 7 is stored in the ROM 64. That is, the data table of constants previously set according to types of tape cassette 5 is stored in the ROM 64.

At S32, ambient temperature of the thermal head 41 is read in an analog value by the thermistor 73 and converted in a digital value. Temperature information obtained at this step is assigned to a variable TH prepared in the RAM 66. After that, the process shifts to S33.

At S33, energization of the thermal head 41 is started. After that, the process shifts to S34.

At S34, voltage at the thermal head 41 in a normal state is read in an analog value and converted in a digital value. The voltage read and converted in digital is assigned to a variable V. The variable V is stored in the RAM 66. After that, the process shifts to S35.

At S35, a variable CHP_Duty for a chopping duty ratio is determined. A variable CHP_Duty is determined based on a data table of a proper rank while the variable V (voltage at the thermal head 41) obtained at S34 is used as a parameter. Having been explained already at [Outline of "Astable Energization Control Method"] in detail, how to find rank to which a measured resistance value of the thermal head 41 belongs will be omitted. Specific examples of data tables are shown in FIG. 9 through FIG. 11. In each of the data tables shown in FIG. 9 through FIG. 11, the "duty" column recites variables CHP_Duty for chopping duty ratios. Incidentally, a variable CHP_Duty is stored in the RAM 66. The data tables shown in FIG. 9 are stored in the ROM 64. After that, the process shifts to S36.

At S36, it is determined whether or not to keep pulse application of the thermal head 41 (energization of the thermal head 41). This determination is made based on duration of pulse application time for the thermal head 41 which is equal to the product of 250 μm sec. as a unit time and the above variable CHP_Duty. In a case where it is determined to keep pulse application to the thermal head 41 (energization of the thermal head 41) (S36: YES), the process returns to S36 itself for repeating S36. In a case where it is determined not to keep pulse application to the thermal head 41 (energization of the thermal head 41) (S36: NO), the process shifts to S37.

At S37, energization of the thermal head 41 is stopped. After that, the process shifts to S38.

At S38, it is detected whether or not a unit time (250 μm sec.) has passed since start of energization at S33. In a case where a unit time (250 μm sec.) has not passed since start of energization at S33 (S38: NO), the process returns to S38 itself for repeating S38. In a case where a unit time (250 μm sec.) has passed since start of energization at S33 (S38: YES), the process shifts to S39.

At S39, a current decreasing variable number C is replaced with a new decreasing variable number C by decrementing a value C(V) related to the variable V (voltage V of the thermal head 41) at S34 from the previous decreasing variable number C. In this connection, a value C(V) related to the variable V (voltage V of the thermal head 41) at S34 is read from a "C(V)" column of one of the data tables shown in FIG. 9 through FIG. 11. More specifically, in a case where a measured resistance value of the thermal head 41 falls within the rank B with voltage level of 9.0 V at the thermal head 41 as shown in FIG. 10, for instance, "4564" is read out as a value C(V) related to the variable V (voltage V of the thermal head 41) at S34. In a case of the rank B with voltage level of 7.5 V at the thermal head 41, "4164" is read out as a value C(V) related to the variable V (voltage V of the thermal head 41) at S34.

Meanwhile, a value C(V) related to the variable V (voltage of the thermal head 41) at S34 is corrected by using a corrective coefficient K (TH) which is related to a variable TH (ambient temperature of the thermal head 41) at S32. A corrective coefficient K (TH) is read from the "corrective coefficient" column in the data table shown in FIG. 12. More specifically, in a case where a variable TH (ambient temperature of the thermal head 41) at S32 is 14 degrees Celsius, "0.80" is read out as a corrective coefficient K (TH) related to the variable TH (ambient temperature of the thermal head 41) at S32. Further, in a case where a variable TH (ambient temperature of the thermal head 41) at S32 is 25 degrees Celsius, "1.00" is read out as a corrective coefficient K (TH) related to the variable TH (ambient temperature of the thermal head 41) at S32. The data table shown in FIG. 12 is stored in the ROM 64.

As to ambient temperature and voltage of the thermal head 41 used at S39, a variable TH (ambient temperature of the thermal head 41) at S32 and a variable V (voltage of the thermal head 41) at S34 are used without correction. After that, the process shifts to S40.

At S40, it is detected whether or not the renewed decreasing variable number C renewed at S39 is under "0". In a case where the renewed decreasing variable number C is not under "0" (S40: NO), the process returns to S32 and processes to follow S32 are repeated. In a case where the renewed decreasing variable number C is under "0" (S40: YES), the process shifts to S41.

At S41, energization of the thermal head 41 is stopped. After that, the process shifts to S42.

At S42, it is detected whether or not a printing period Ts has passed. In a case where a printing period Ts has not passed (S42: NO), the process returns to S42 and repeated for S42. In a case where a printing period has passed (S42: YES), the process returns to the main program shown in FIG. 5 and further shifts to S21.

5. Summary

The tape printing apparatus 1 carrying out the "astable energization control method" of the present embodiment includes: the thermal head 41 which is made up of plural heat elements 41A serving to perform print on a surface tape 31 by transmitting heat to the surface tape 31; the head driving circuit 68 which apples voltage to the thermal head 41; the head drive voltage detecting circuit 82 which detects voltage applied to the thermal head 41; the thermistor 73 which detects ambient temperature of a heat element 41A of the thermal head 41; the ROM 64 which stores constants as first fixed values corresponding to respective types of surface tapes 31 (tape cassettes 5); the timer 67 which measures passage of a unit time (250 μm sec.); and the control unit 60. Further, the ROM 64 stores a constant K(R) as a second fixed value corresponding to a measured resistance value of the thermal head 41.

The control unit 60 decrements a predetermined value (C(V)×K(TH)) from a constant which is preset according to a type of the surface tape 31 (tape cassette 5) so as to obtain a current decreasing variable number C (S39). After that, the control unit 60 calculates a chopping duty ratio according to voltage (variable V) detected by the head drive voltage detecting circuit 82 and a constant K(R) as a second fixed value corresponding to a measured resistance value of the thermal head 41 (S35) and subsequently controls an energizing time T of the thermal head 41 (S31 through S40), the energizing time T being made up of repetitions of unit time (250 μm sec.).

In the "astable energization control method" carried out by the tape printing apparatus 1 directed to the present embodiment, the following steps (1) through (7) are taken every printing period Ts: (1) a first fixed value corresponding to a type of a surface tape 31 (tape cassette 5) subjected to print by the thermal head 41 is set as initial value of the decreasing variable number C and a constant K(R) is determined as a second fixed value corresponding to a measured resistance value of the thermal head 41 (S31); (2) energization of the thermal head 41 is started immediately after the start of the printing period Ts (S33) and ambient temperature and voltage of the thermal head 41 are detected (S32, S34); (3) a variable CHP_Duty for a chopping duty ratio is determined according to the constant K(R) as the second fixed value which is determined based on the detected ambient temperature and voltage of the thermal head 41 (S35); (4) energization of the thermal head 41 is started and kept until lapse of a pulse application time which is calculated based on the thus determined variable CHP_Duty for the chopping duty ratio (S36: YES); (5) energization of the thermal head 41 is stopped at lapse of the pulse application time and thereafter withheld until lapse of the unit time (250 μm sec.), the pulse application time having been calculated based on the thus determined variable CHP_Duty for the chopping duty ratio in the unit time (S37, S38: NO); (6) a value (C(V)×K(TH)) calculated based on temperature and voltage of the thermal head 41 is decremented from the current decreasing variable number C so as to obtain a renewed variable number C (S39); and (7) in a case where the renewed decreasing variable number C is not under a predetermined value (i.e., larger than "0") (S40: NO), the series of the above steps (2) through (6) are repeated, while in a case where the renewed decreasing variable number C is under the predetermined value (i.e., the same as or smaller than "0"), energization of the thermal head 41 is withheld until lapse of a printing period Ts (S41, S42: NO).

That is, according to the "astable energization control method" carried out by the tape printing apparatus 1 directed to the present embodiment, the series of the above steps (2) through (6) is repeated as long as the renewed decreasing variable number C is not under a predetermined value (i.e., larger than "0") (S40: NO) while in a case where the renewed decreasing variable number C is under the predetermined value (i.e., the same as or smaller than "0"), energization of the thermal head 41 is withheld until lapse of a printing period Ts (S41, S42: NO). In this connection, at S35 in the above step (3), a variable CHP_Duty for a chopping duty ratio is determined according to the constant K(R) as the second fixed value which is determined only based on the detected ambient temperature and voltage of the thermal head 41 and subsequently, at S39 in the above step (6), a value (C(V)×K(TH)) calculated based on temperature and voltage of the thermal head 41 is decremented from the current decreasing variable number C so as to obtain a renewed decreasing variable number C. That is, regarding thermal head 41, an error of resistance value between a measured value and a true value as well as ambient temperature can be reflected the above steps (3) and (6) for the astable energization control.

According to the "astable energization control method" carried out by the tape printing apparatus 1 directed to the present embodiment, as shown in FIG. 8A and FIG. 8B, a predetermined range falling within more than 85% to less than 105% with reference to the true value of resistance value of the thermal head 41 is set. The predetermined range is further classified into equally-divided three ranges (i.e., rank A, rank B and rank C) to which constants K(R) as second fixed values unique to one another, (i.e., "0.9" for rank A, "1.0" for rank B and "1.1" for rank C) are set and one of the constants K(R) (i.e., "0.9", "1.0" or "1.1) is used depending on a range a measured resistance value of the thermal head 41 falls within. Therefore, in further minute detail, a resistance value error of the thermal head 41 can be reflected in the astable energization control.

According to the "astable energization control method" carried out by the tape printing apparatus 1 directed to the present embodiment, in a case where a constant K(R) as a second fixed value is determined to be "1.1" according to a measured resistance value of the thermal head 41 (i.e., in a case where the a measured resistance value of the thermal head 41 falls within rank C) and voltage of the thermal head 41 detected at S34 is 7.7 V or lower, a variable CHP_Duty for a chopping duty ratio to be determined at S35 is set to "100%" (i.e., "1") as indicated at the "duty" column of the data table shown in FIG. 11. That is, since pulse application energy is secured sufficiently even at low voltage, energization time of the thermal head 41 can be controlled appropriately.

According to the "astable energization control method" carried out by the tape printing apparatus 1 directed to the present embodiment, in a case where voltage detected at S34 is 7.7V or lower, a variable CHP_Duty for a chopping duty ratio to be determined at S35 is set to "100%" (i.e., "1") on condition that a constant K(R) as a second fixed value is determined to be "1.1" according to a measured resistance value of the thermal head 41 (i.e., in a case where the a measured resistance value of the thermal head 41 falls within rank C). Thereby, pulse application energy is secured sufficiently. In this connection, a rare case is such that a variable CHP_Duty for a chopping duty ratio to be determined at S35 is set to "100%" (i.e., "1") while most cases are such that a variable CHP_Duty is set under "100%" (i.e., under "1"). Therefore, in further minute detail, a resistance value error of the thermal head 41 can be reflected in the astable energization control.

According to the "astable energization control method" carried out by the tape printing apparatus 1 directed to the present embodiment, in a case where a constant K(R) as a second fixed value is determined to be "1.1" according to a measured resistance value of the thermal head 41 (i.e., in a case where the measured resistance value of the thermal head 41 falls within rank C) and voltage of the thermal head 41 detected at S34 is higher than 7.7 V (a threshold), a variable CHP_Duty for a chopping duty ratio to be determined at S35 is appropriately set based on average amount of energy generated per unit time (250 μm sec.) at low voltage range of under 7.7 V (namely, 7.2 V to 7.7 V) as indicated at the "duty" column and the "power" column of the data table shown in FIG. 11. Therefore, energization time of the thermal head 41 can be controlled properly even at high voltage.

6. Others

The present disclosure is not limited to the above-described embodiment, and therefore, modifications can be made thereto without departing from the spirit of the disclosure.

For instance, in the "astable energization control" shown in FIG. 6, the step of S34 may be carried out prior to the step S33, more specifically, voltage of the thermal head 41 under normal state may be assigned to the variable V before starting energization of the thermal head 41.

Further, in the "astable energization control method" carried out by the tape printing apparatus 1 directed to the present embodiment, a predetermined range (falling within more than a true value×85% to less than a true value×105%) in which a true value of resistance value of the thermal head 41 is centered is set and further classified into equally-divided three ranges, as shown in FIG. 8A and FIG. 8B. The predetermined range in which a true value of resistance value of the thermal head 41 is centered, however, may be classified into equally-divided two, four, five, etc. several ranges. In this regard, however, it is not essential to classify the predetermined range into plural ranges. In a case where the number of equally-divided ranges is changed, value of a constant K(R) as a second fixed value shall be changed accordingly.

Further, in the "astable energization control method" carried out by the tape printing apparatus 1 directed to the present embodiment, the ROM 64 stores a measured resistance value of the thermal head 41, the rank-classification data table shown in FIG. 8B and the data tables of respective ranks A, B and C shown in FIG. 9 through FIG. 11. In this connection, the ROM 64 may be configured to store only a constant K(R) as a second fixed value or one of the data tables shown in FIG. 9 through FIG. 11 relevant to an appropriate rank, whereby available memory of the ROM 64 can be made large.

While presently exemplary embodiments have been shown and described, it is to be understood that this disclosure is for the purpose of illustration and that various changes and modifications may be made without departing from the scope of the disclosure as set forth in the appended claims.

What is claimed is:

1. A method for thermal head energizing time control at astable voltage, the method comprising:

for every printing period:

(1) setting a first fixed value as an initial value of a decreasing variable number and a second fixed value, the first fixed value corresponding to a type of printing medium subjected to printing by the thermal head and the second fixed value corresponding to a measured resistance value of the thermal head;

(2) starting energization of the thermal head immediately after a start of a printing period simultaneously with detecting temperature and voltage of the thermal head;

(3) determining a chopping duty ratio based on the voltage of the thermal head detected at the step (2) and the second fixed value set at the step (1);

(4) starting energization of the thermal head and keeping the energization until a pulse application time has lapsed, the pulse application time being calculated based on the chopping duty ratio determined at the step (3);

(5) stopping the energization of the thermal head upon the pulse application time, calculated based on the chopping duty ratio determined at the step (3), lapsing, and withholding the energization until a unit time has lapsed;

(6) decrementing a calculation value from the decreasing variable so as to obtain a renewed decreasing variable number, the calculation value being calculated by using the temperature and the voltage of the thermal head detected at the step (2); and (7) repeating the steps (2) through (6) in a case where the renewed decreasing variable number is larger than a predetermined value whereas withholding the energization of the thermal head until the printing period has lapsed in a case where the renewed decreasing variable number is equal to or smaller than the predetermined value.

2. The method for thermal head energizing time control at astable voltage according to claim 1, wherein there is set a predetermined numerical range in which a true value of a resistance value of the thermal head is centered and the predetermined range is divided into plural sub numerical ranges, wherein the second fixed value has value variations, each of the value variations falling within a proper one of the plural sub numerical ranges according to a value of the second fixed value, and wherein the second fixed value for an appropriate sub numerical range within which the measured resistance value of the thermal head falls is used at the step (1).

3. The method for thermal head energizing time control at astable voltage according to claim 2, wherein, in a case where the voltage detected at the step (2) is equal to or lower than a threshold, a value of the chopping duty ratio is set to "1" at the step (3).

4. The method for thermal head energizing time control at astable voltage according to claim 3, wherein a numerical range including the measured resistance value of the thermal head is a specific numerical range.

5. The method for thermal head energizing time control at astable voltage according to claim 3, wherein, in a case where the voltage detected at the step (2) is higher than the threshold, an appropriate value of the chopping duty ratio to be determined at the step (3) is set based on average amount of energy given to the thermal head per unit time when the voltage of the thermal head is equal to or lower than the threshold within a predetermined voltage range.

6. The method for thermal head energizing time control at astable voltage according to claim 4, wherein, in a case where the voltage detected at the step (2) is higher than the threshold, an appropriate value of the chopping duty ratio to be determined at the step (3) is set based on average amount of energy given to the thermal head per unit time when the voltage of the thermal head is equal to or lower than the threshold within a predetermined voltage range.

7. A method for thermal head energizing time control at astable voltage, the method comprising:

for every printing period:

(1) setting a first fixed value as an initial value of a decreasing variable number and a second fixed value, the first fixed value corresponding to a type of printing medium subjected to printing by the thermal head and the second fixed value corresponding to a measured resistance value of the thermal head;

(2) starting energization of the thermal head immediately after a start of a printing period simultaneously with detecting temperature and voltage of the thermal head;

(3) determining a chopping duty ratio based on the voltage of the thermal head detected at the step (2) and the second fixed value set at the step (1);

(4) starting energization of the thermal head and keeping the energization until a pulse application time has lapsed, the pulse application time being calculated based on the chopping duty ratio determined at the step (3);

(5) stopping the energization of the thermal head upon the pulse application time, calculated based on the chopping duty ratio determined at the step (3), lapsing, and withholding the energization until a unit time has lapsed;

(6) decrementing a calculation value from the decreasing variable number so as to obtain a renewed decreasing variable number, the calculation value being calculated by using the temperature and the voltage of the thermal head detected at the step (2); and (7) repeating the steps (2) through (6) in a case where the renewed decreasing variable number is larger than a predetermined value, whereas withholding the energization of the thermal head until the printing period has lapsed in a case where the renewed decreasing variable number is equal to or smaller than the predetermined value, wherein, in a case where the voltage detected at the step (2) is equal to or lower than a threshold, a value of the chopping duty ratio is set to "1" at the step (3).

8. The method for thermal head energizing time control at astable voltage according to claim 7, wherein, in a case where the voltage detected at the step (2) is higher than the threshold, an appropriate value of the chopping duty ratio to be determined at the step (3) is set based on average amount of energy given to the thermal head per unit time when the voltage of the thermal head is equal to or lower than the threshold within a predetermined voltage range.

* * * * *